US006405737B1

(12) United States Patent
Sheffler et al.

(10) Patent No.: US 6,405,737 B1
(45) Date of Patent: Jun. 18, 2002

(54) LIPSTICK PACKAGE WITH DISPENSING COMPARTMENT(S)

(75) Inventors: Robert J. Sheffler, Morganville, NJ (US); Charles Chang, 55 Westview Rd., Wayne, NJ (US) 07470

(73) Assignee: Charles Chang, Wayne, NJ (US)

( * ) Notice: Subject to any disclaimer, the term of this patent is extended or adjusted under 35 U.S.C. 154(b) by 0 days.

(21) Appl. No.: 09/828,672

(22) Filed: Apr. 9, 2001

(51) Int. Cl.[7] ..... A45D 40/24; A45D 40/26; A45D 33/28

(52) U.S. Cl. ..... 132/318; 132/314; 132/320; 132/297

(58) Field of Search ..... 132/297, 317, 132/320, 318, 306; 401/52, 49, 89

(56) References Cited

U.S. PATENT DOCUMENTS 2,414,245 A * 1/1947 Rudd ..... 132/320
2,964,045 A * 12/1960 Otto et al. ..... 401/52
2,964,170 A * 12/1960 Otto et al. ..... 401/52
3,230,960 A * 1/1966 Moore et al. ..... 401/52
5,069,232 A * 12/1991 Staar ..... 132/320
5,373,940 A * 12/1994 Hillelson ..... 206/385
5,715,961 A * 2/1998 Robertson ..... 215/319
5,964,226 A * 10/1999 Sobel ..... 132/108
6,035,866 A * 3/2000 Seneco et al. ..... 132/318
6,241,408 B1 * 6/2001 Lang ..... 401/17

* cited by examiner

*Primary Examiner*—John J. Wilson
*Assistant Examiner*—Robyn Kieu Doan
(74) *Attorney, Agent, or Firm*—Charles I. Brodsky

(57) ABSTRACT

A lipstick package in which a normally closed, openly accessible compartment is included at least at one of a bottom of a lipstick cartridge and at an underside of its cover for the storage of a secondary lipstick-related product beyond the lipstick pomade which is propelled above its defining rim for use, or retracted below it for closure.

11 Claims, 9 Drawing Sheets

LIPSTICK PACKAGE WITH DISPENSING COMPARTMENT(S)

CROSS-REFERENCE TO RELATED APPLICATIONS

None

STATEMENT REGARDING FEDERALLY SPONSORED RESEARCH OR DEVELOPMENT

Research and development of this invention and Application have not been federally sponsored, and no rights are given under any Federal program.

REFERENCE TO A MICROFICHE APPENDIX

Not Applicable

BACKGROUND OF THE INVENTION

1. Field of the Invention

This invention relates to lipstick cartridges and, more particularly, to a modification of such lipstick cartridges so that they can be utilized for the application of secondary lipstick-related products, as well.

2. Description of the Related Art

As is well known and understood, recent introductions in the lipstick-related cosmetics product industry have included powdered glitter flakes for application to one's lips after a color pomade has been applied, liquid gels & moisturizers, and various forms of molded glosses & liplners as secondary products—all to enhance one's appearance.

OBJECTS OF THE INVENTION

It is an object of the present invention to provide a new and improved lipstick cartridge having compartments from which these secondary lipstick-related products can be stored conveniently and dispensed easily.

It is another objection of the invention to provide an improved cartridge of this type as a package incorporating a design in which the molded lipstick pomade is traditionally applied.

It is a further object of the invention to provide such a package with a minimum amount of modification to those lipstick cartridge designs which have been widely accepted both in the United States and internationally, in the past and at present.

It is yet another object of the invention to provide such a package for dispensing both powdered and liquid lipstick-related products, as well as for dispensing other secondary molded lipstick products.

As will become clear from the following description, these objects are achieved according to the invention through the creation of new and accessible compartments in the lipstick cartridge, providing storage for secondary lipstick-related products and means for dispensing them.

SUMMARY OF THE INVENTION

Thus, and as will be seen, a first embodiment of the invention includes a container inserted into the bottom of the traditional lipstick package, and fixed there in position—with a terminal opening of the container being sealed by means of an openable hinged lid. In a second embodiment, an apertured sifter is fitted into the container for dispensing a powdered product. In a third embodiment, a roll-on dispensing package is fitted into the walls of the container for applying low viscosity gels, moisturizers and liquid glosses.

In yet a further embodiment of the invention, the container is incorporated in the underside of the cover of the lipstick package. While such an arrangement is especially attractive for allowing a consumer to view a faux representation of the lipstick pomade in assessing its color and reflective quality without actually seeing its tip, it will be appreciated that the powdered products and various liquids could be dispensed from this container as well. In this embodiment—as well as in the embodiment with the container in the bottom of the lipstick cartridge—, a molded and pigmented lip gloss can be included for visual presentation.

Common to all embodiments of the invention, however, will be seen to be the use of an auxiliary container in the cartridge case forming a compartment to contain and dispense something other than just the lipstick pomade mass.

(The advantages which follow from being able to view a faux representation of the lipstick without disturbing the lipstick in the cartridge are set out in our pending U.S. patent application entitled "Lipstick Cartridge With Display", Ser. No. 09/732,819, filed Dec. 11, 2000.)

BRIEF DESCRIPTION OF THE DRAWINGS

These and other features of the invention will be more clearly understood from a consideration of the following description, taken in connection with the accompanying drawings, in which.

DETAILED DESCRIPTION OF THE INVENTION

Figure 1:
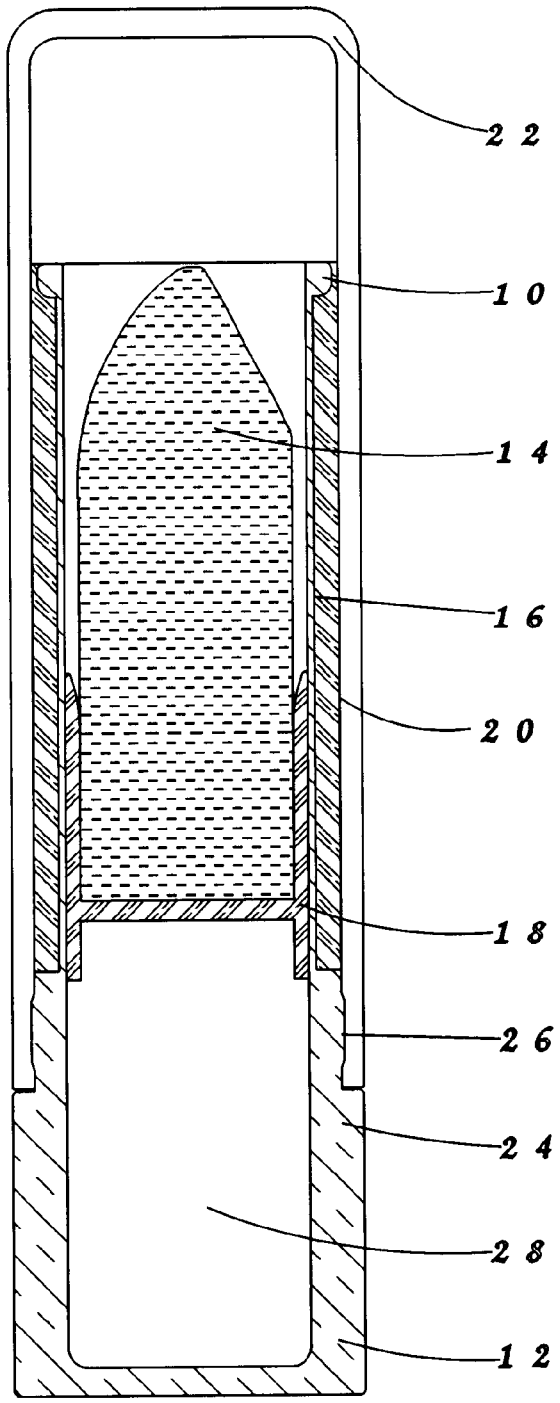
FIG. 1 is a vertical cross-section view of a traditional, internationally accepted design of a lipstick cartridge helpful in understanding the present invention.

As is well known and understood, the traditional lipstick cartridge of FIG. 1 includes a slotted shell 10 which extends into a base 12, directing vertical travel of the lipstick pomade 14 upwardly or downwardly as it is propelled and retracted. Conventionally designated as the C-shell, the slotted shell 10 is surrounded by a spiral shell 16 housing a helical track or keyway (conventionally designated the B-shell). An elevator cup 18 is included to contain and secure the pomade 14, and includes a pair of oppositely aligned lugs or drift-pins (not shown) which extend outwardly of the cup 18 through the slotted shell 10 into the helical track of the spiral shell 16. Rotational movement of the slotted shell 10 within the spiral shell 16 imparts vertical travel of the elevator cup upwardly (propelling) or downwardly (retracting) the lipstick. The molded pomade may comprise a moisturizing stick, color lip cosmetic or blush presented as the pomade 14. In typical construction, the spiral shell 16 is frequently combined with an outer shell 20 in forming what is conventionally designated as the A-shell. Reference numeral 22 then identifies a cover or cap which fits over the combined construction—gripping the slotted shell 10 at an intermediate extension (shown at 24), usually via frictional interference with externally located radial vertical ribs 26.

As will be appreciated by those skilled in the art, the length of the A-shell 20 and the positioning of its helical keyway can be selected in setting how far upwardly from the shells (all internally cylindrical) the pomade 14 can extend, and how far downwardly into the cartridge both it and the elevator cup 14 can be retracted. As will be understood, this allows a chamber 28 to exist within the cartridge of FIG. 1 and allows, in accordance with the invention, the incorporation therein of a convenient secondary compartment for containing and thereafter dispensing, secondary lipstick related products.

Following the teachings of our afore-noted pending patent application, the slotted shell 10 and the spiral shell 16 are configured with the helical keyway to locate the elevator cup 18 so that at its most retracted position, the pomade 14 is completely recessed within the cartridge, at or below the upper rims of all the cylindrical shells. This permits a relatively sizable chamber 28 to be incorporated within the lipstick cartridge.

Figure 2:
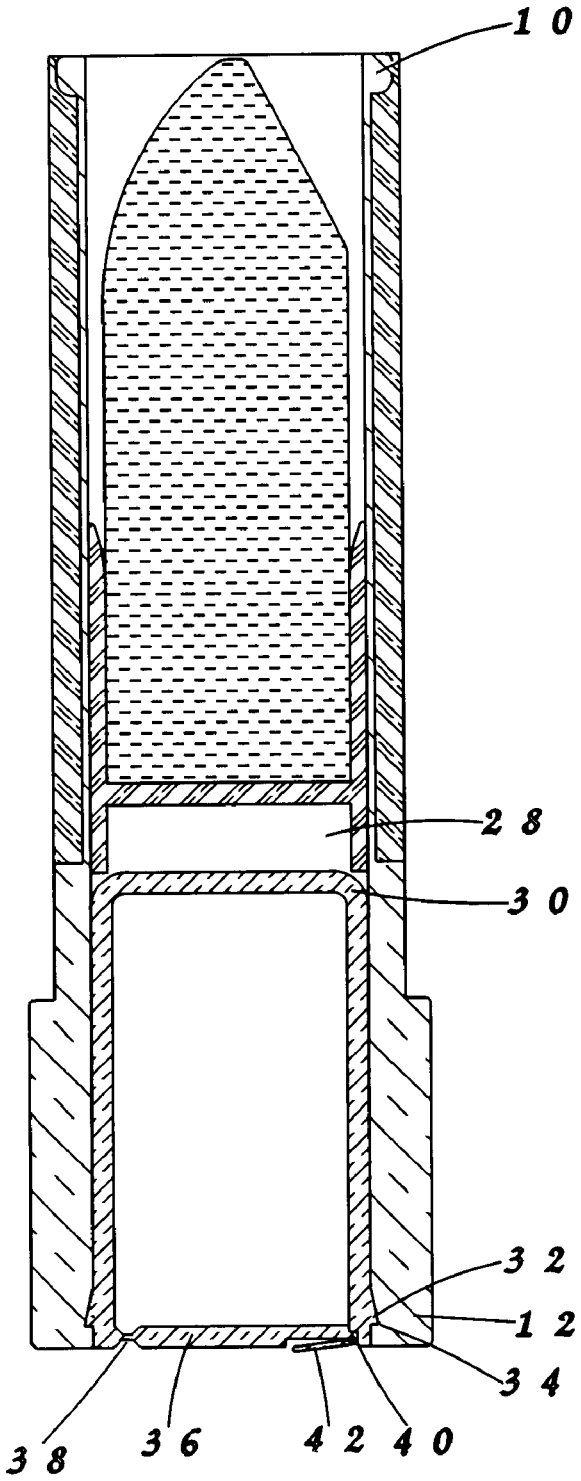
FIGS. 2–9 are vertical cross-section views of modifications to the lipstick cartridge of FIG. 1 for converting the cartridge into a package with storage and dispensing compartment(s) in accordance with the teachings of the invention.
Figure 3:
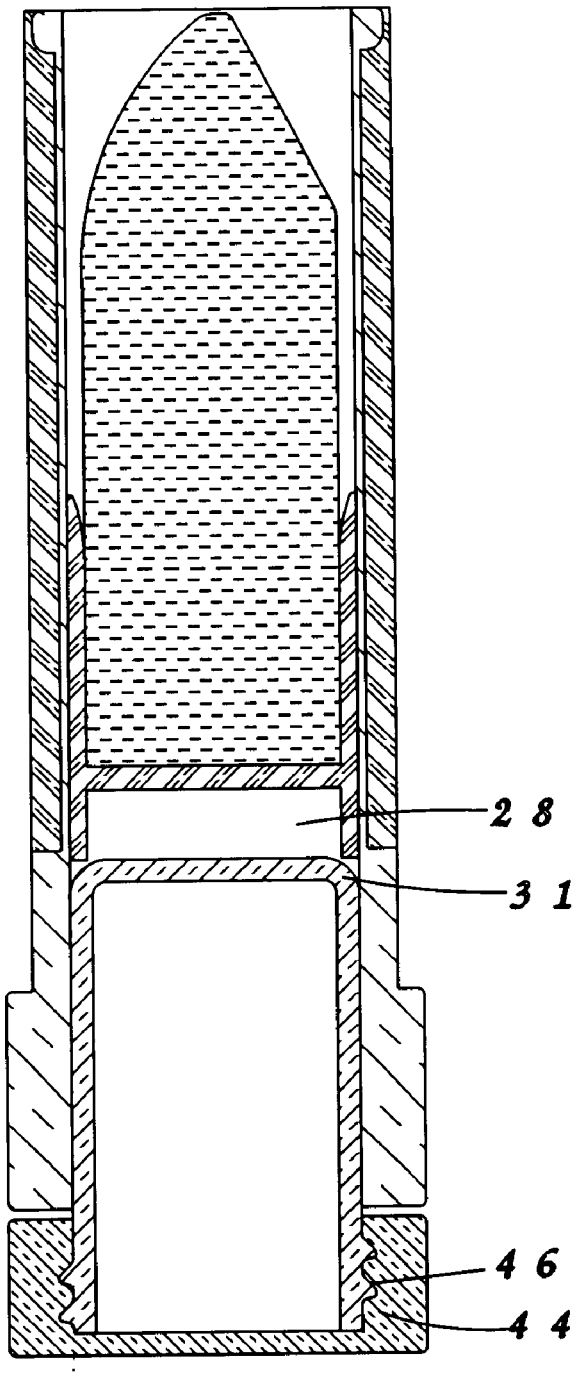

The embodiments of the invention shown in FIGS. 2 and 3 illustrate how a container may be inserted into the chamber area 28 in forming a compartment for storing and later dispensing secondary lipstick-related products. In FIG. 2, a polyolefin container 30 is inserted into the chamber 28 at the bottom of the lipstick cartridge and secured in position by a circular locking ring 32, cooperating with an undercut 34 added to the slotted shell 10 at its base 12. The terminal opening for access to the container 30 is sealed by a hinged lid 36, operating via a living hinge 38 with a positive stop 40 and a flap or pull tab 42 providing an appendage to be gripped for pulling open the lid 36. Any secondary lipstick related product in the compartment within can thus be easily accessed.

In the embodiment of FIG. 3, on the other hand, a container 31 inserted into the chamber 28 has its terminal opening sealed by a continuous thread closure 44 which mates with threads 46 on the container 31. In the embodiment of FIG. 3—as well as in the embodiments of FIGS. 4, 6, 8 and 9—, the container is press-fitted into the chamber 28 and utilizes a continuous thread construction for affecting a seal, although in these five versions, a securement by a projection-and-cooperating-undercut construction as in the embodiment of FIG. 2 could be employed alternatively.

Figure 4:
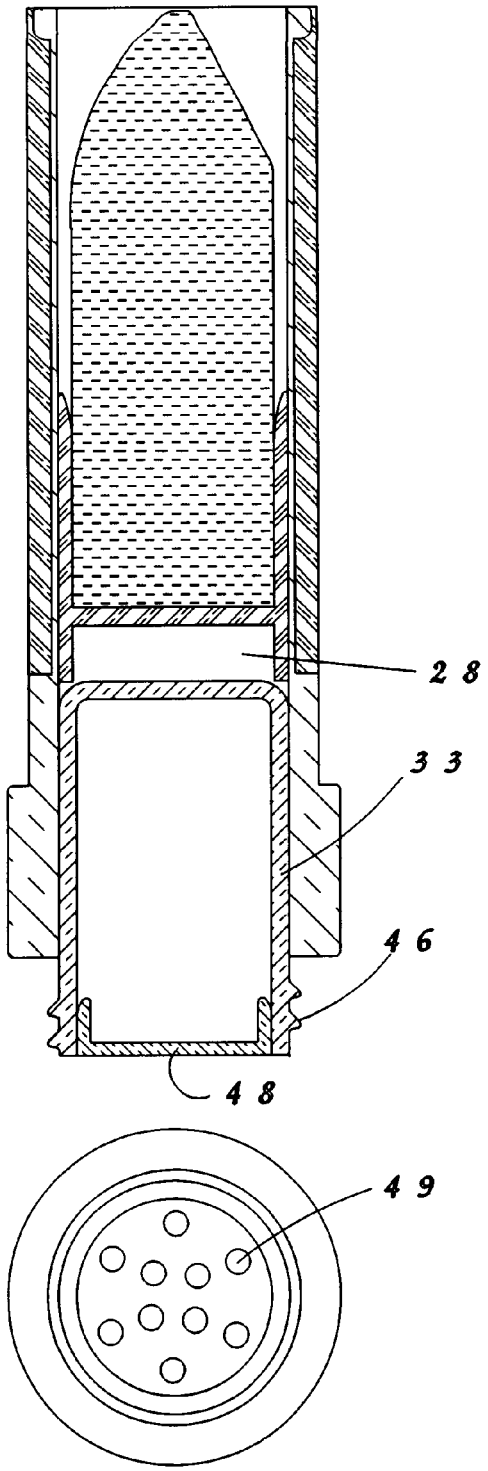

In the embodiment of the invention illustrated in FIG. 4, the container 33 is likewise press-fitted into the chamber 28 to form the compartment for the lipstick-related product. A lid 48, having geometrically arranged series of orifices 49, closes off the compartment in storing and dispensing a powdered product, such as a glitter flake. With the orifices 49, the lid 48 serves as a sifter, and is secured by the threads 46 with the closure 44 of FIG. 3.

Figure 6:
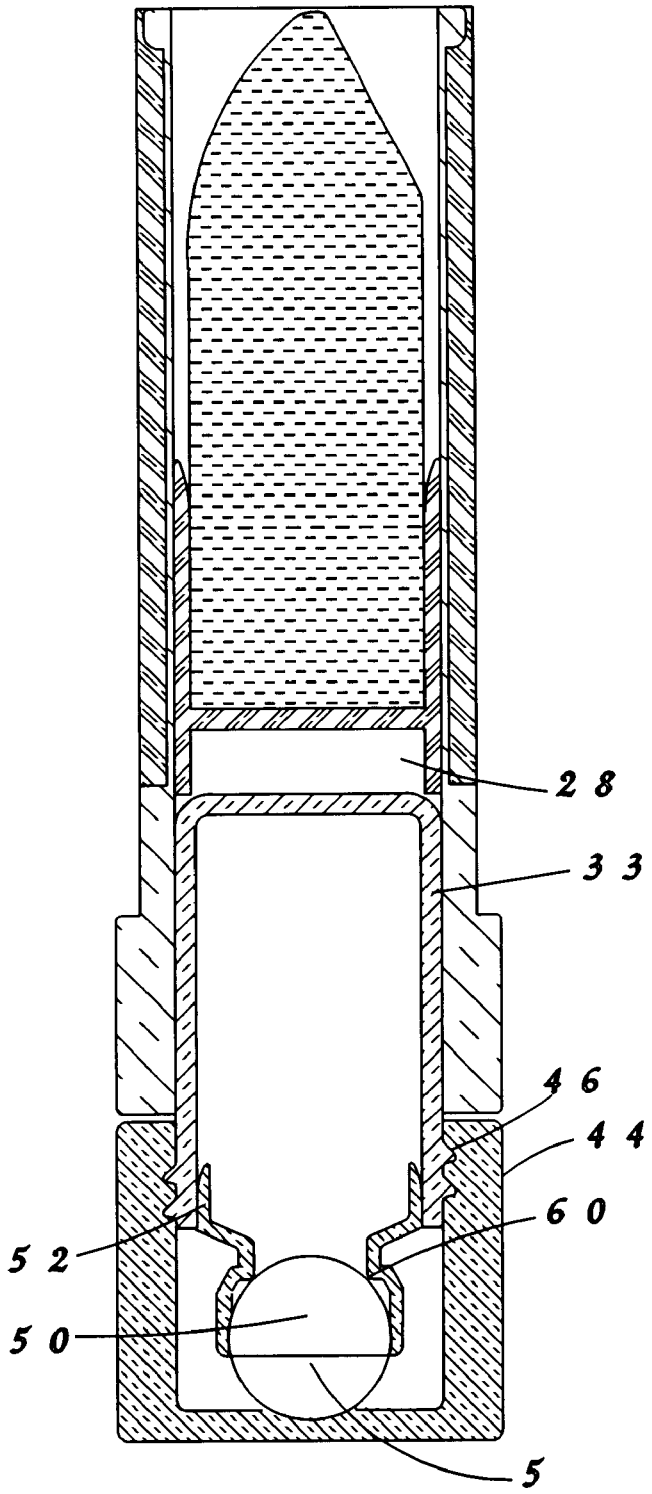

A similar pres-fit of the container 33 into the chamber 28 at the bottom of the lipstick cartridge is shown in the embodiment of FIG. 6—but without the sifter lid 48 being utilized. Particularly suited for storing and dispensing low viscosity gels, moisturizers and liquid glosses, the embodiment of FIG. 6 employs a roll-on dispensing package of typical construction 50, with the roll-on fixture 52 along with its head 58 being fitted between the walls of the container 33. Here, the sealing of the container 33 is accomplished through the use of the continuous thread closure of 44, 46, which forces the ball 58 into the seat 60 as torque is being applied to seal the compartment for storage.

Figure 5:
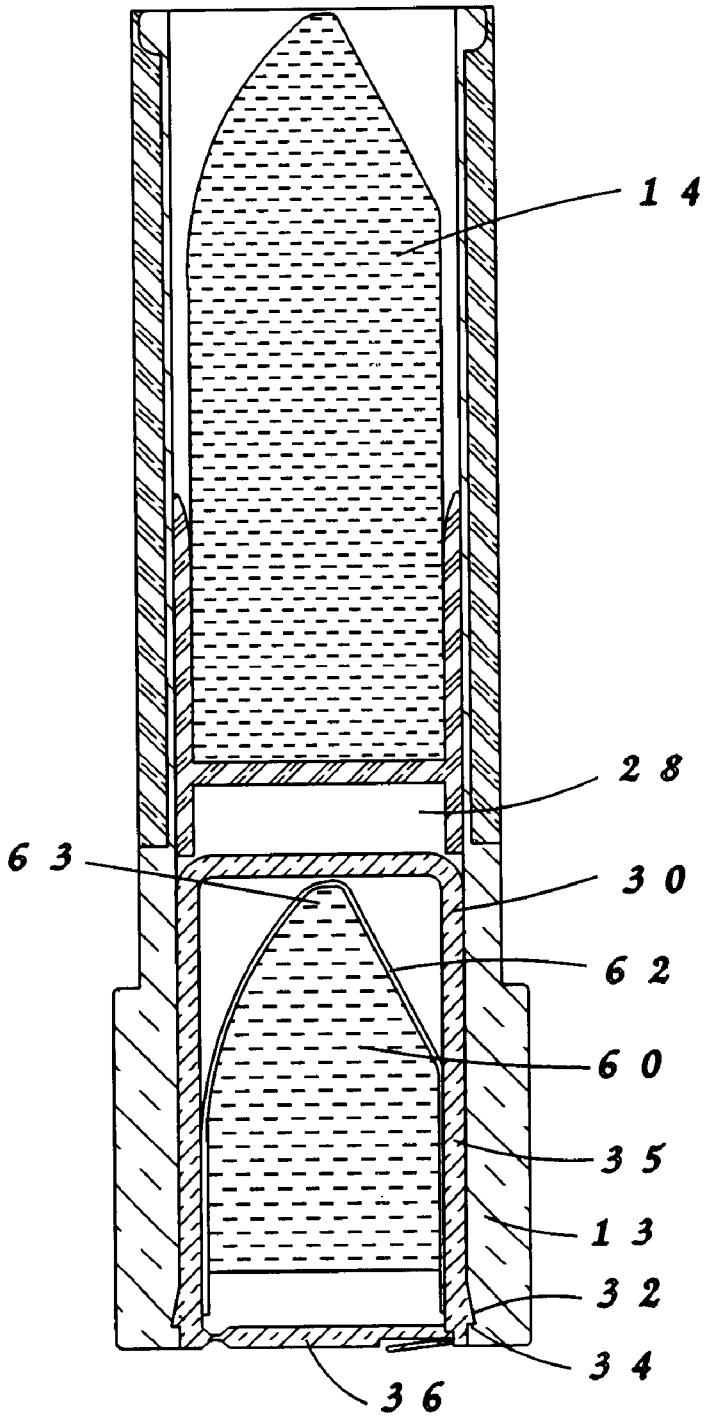

The embodiment of the invention shown in FIG. 5, on the other hand, employs the container 30 of FIG. 2 secured within the chamber 28 by the locking ring 32 and the cooperating undercut 34 along with the hinged lid 36. Such an accessory lipstick-related product as a molded gloss or lipliner 60 is shown within the container 30, introduced as a molten mass in a cavity 62, to produce a form like that of the primary lipstick pomade 14, with a correspondingly-shaped tip 63. Were the opaque cover 22 of FIG. 1 to be used for the lipstick cartridge, by utilizing a transparent extension 13 for the slotted shell 10 along with a container 30 of transparent side walls 35, a consumer would then have the opportunity to observe and determine the color, reflective qualities, tip-shape, and surface characteristics of the lipstick 14, by examining the faux representation 60, without having to first remove the cover 22 and possibly damaging the tip of the lipstick by striking it when replacing the cover. As will be readily appreciated by those skilled in the art, the cavity 62 could be a transparent vacuum or pressure formed insert with a thin wall.

Figure 7:
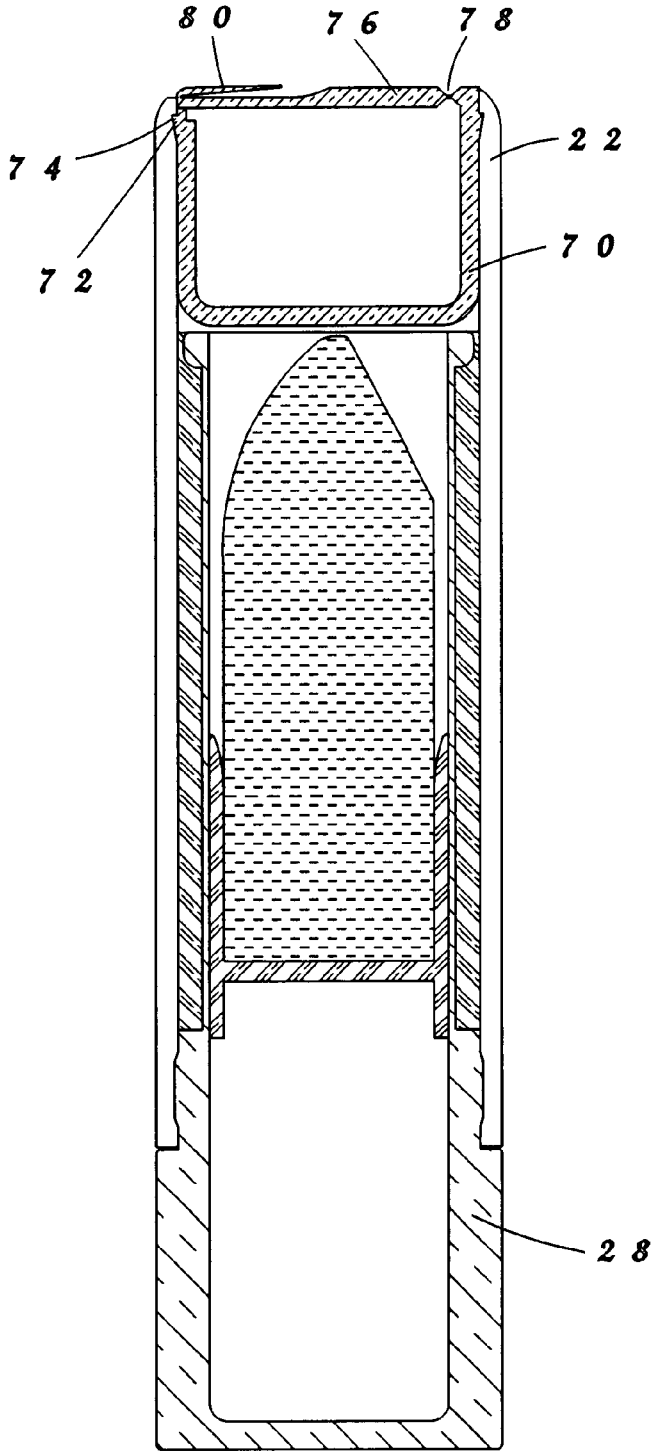

The embodiment of FIG. 7 follows the recognition of the invention that the storage and dispensing compartment can be incorporated as well, at the underside of the cover. In the construction of FIG. 7, the chamber 28 is thus shown devoid of any container, while a container 70 is fitted into the underside of the cartridge cover 22. As with the embodiment of FIG. 2, the container 70 is secured by a locking ring 72 and a cooperating undercut 74, with the terminal opening for access to the container 70 being by way of the normally closed hinged lid 76. The living hinge is shown at 78 with the flap or pull-tab 80 being available for pulling open the lid to gain access. While being of shallower dimension than the compartment so formed by the container 30 in the embodiment of FIG. 2, the other container arrangements of FIGS. 3—6 could be incorporated at the underside of the cover 22 in similar manner.

Figure 8:
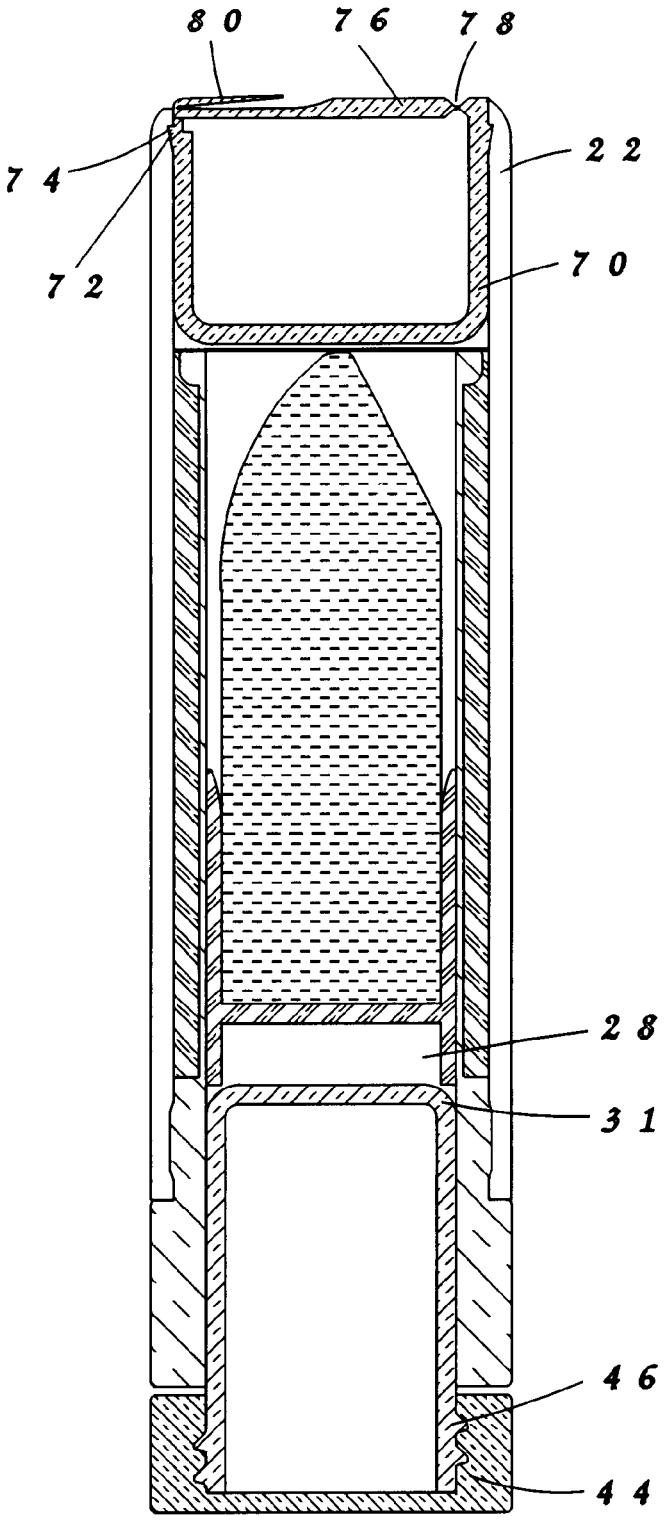

The embodiment of the invention shown in FIG. 8, on the other hand, once again includes the compartment of FIG. 7 included at an underside of the cover 22. This embodiment goes beyond that of FIG. 7, however, in its inclusion of a second auxiliary compartment within the chamber 28 of the lipstick cartridge. In particular, the chamber 28 is shown to include the container 31 and its components of FIG. 3 in providing separate compartments, at both available locations.

Figure 9:
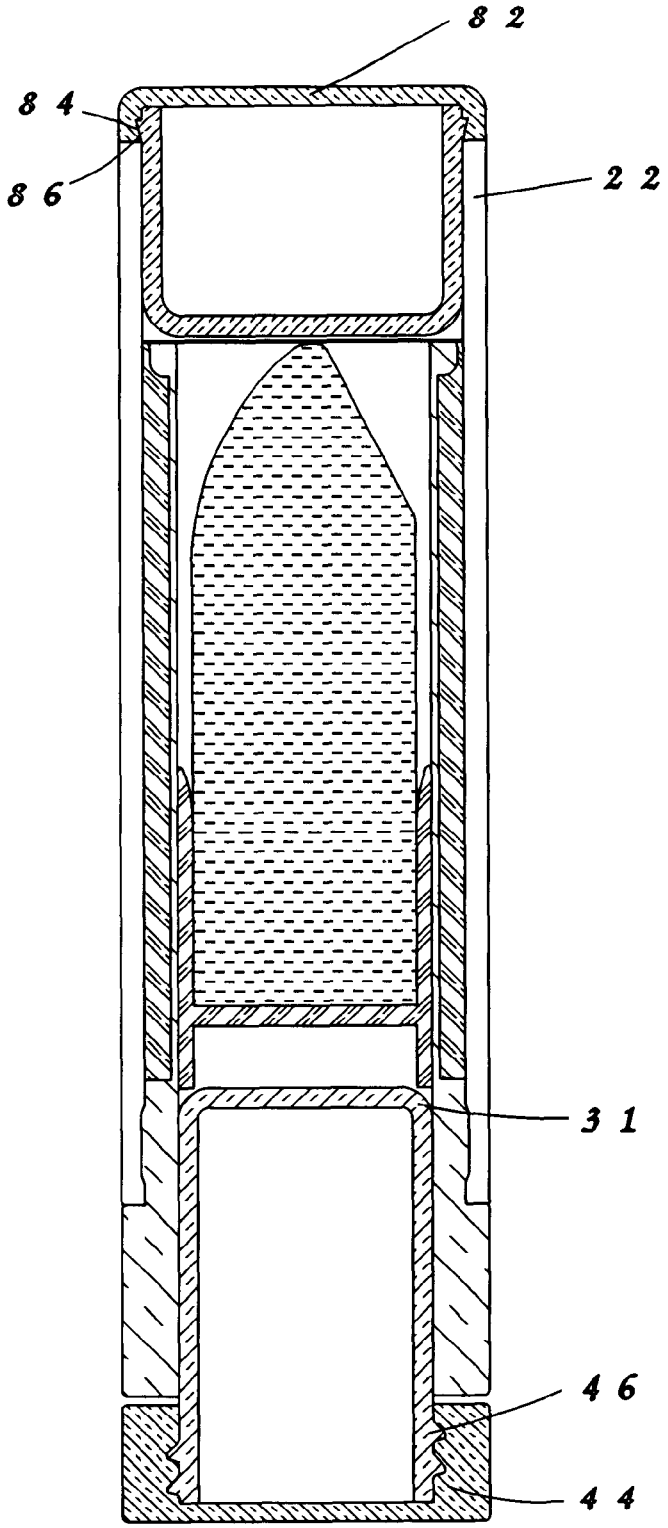

The embodiment in FIG. 9 will be seen to incorporate the compartment of FIG. 8 located in the lower portion of the lipstick cartridge, and employs a snap-lid for a second compartment at the underside of the cover 22. The snap-lid is depicted at 82 and is held by means of an undercut 84 cooperating with a sealing ring 86.

While there have been described what are considered to be preferred embodiments of the present invention, it will be readily appreciated by those skilled in the art that modifications can be made without departing from the scope of the teachings herein, employing presently unused space within a conventional lipstick cartridge for the storage and dispensing of lipstick-related products other than the primary lipstick pomade. As will also be appreciated, this teaching follows whether the cartridge be of the traditional construction here set forth, or of a modification thereof—and whether the illustrated manners of sealing the compartments employ those configurations shown, or other alternative designs. For at least such reasons, therefore, resort should be had to the claims appended hereto for a true understanding of the scope of the invention.

We claim:

1. A lipstick package comprising:

a substantially cylindrical hollow cartridge having an open lower end including a chamber, and an open upper end defined by a rim above said chamber, a lipstick pomade of predetermined tip within said cartridge;

means cooperating with said cartridge for propelling said pomade and said tip above said rim of said cartridge for use, and for retracting said pomade and said tip to a point at or below said rim short of said chamber for closure;

a cover for said cartridge;

a first normally closed, openly accessible integrated compartment inserted within said chamber, and a second normally closed, openly accessible integrated compartment inserted within an underside of said cover at a point above said pomade when retracted within said cover;

and one of a powdered, molded and liquid lipstick-related flake, gel, moisturizer, gloss and lipliner product in each of said first and second compartments.

2. The lipstick package of claim 1 wherein said first compartment includes a container fitted upwardly between downward extending side walls defining said chamber.

3. The lipstick package of claim 2 wherein said container is closably openable via a hingeable lid at a terminus of said container.

4. The lipstick package of claim 2 wherein said container is closably openable via a threaded lid at a terminus of said container.

5. The lipstick package of claim 2 wherein said container is closably openable via a lid press-fitted between said downwardly extending side walls.

6. The lipstick package of claim 2 wherein said container is closably openable via a lid snap-fitted around said downwardly extending side walls.

7. The lipstick package of claim 2 wherein matching friction undercuts and overcuts are provided between said container and said downwardly extending side walls for securing said container with said chamber.

8. The lipstick package of claim 1 wherein said second compartment includes a container press-fitted upwardly between downwardly extending side walls of said cover.

9. The lipstick package of claim 1 wherein each of said compartments is normally closed, openly accessible by one of a hinged lid, a threaded lid, a press-fitted lid and a snap-fitted lid.

10. The lipstick package of claim 9 wherein said cooperating means propels and retracts said lipstick pomade via rotational motion applied to an outer shell of said cartridge through a base thereof, converted to a linear motion by a helical keyway located between said outer shell and a slotted inner shell of said cartridge.

11. The lipstick package of claim 10 wherein said lipstick pomade seats within an elevator cup traveling up and down through a peripheral coupling with said helical keyway.

* * * * *